United States Patent [19]

Kato et al.

[11] Patent Number: 4,910,112

[45] Date of Patent: Mar. 20, 1990

[54] ELECTROPHOTOGRAPHIC MASTER PLATE FOR LITHOGRAPHIC PRINTING

[75] Inventors: Eiichi Kato; Kazuo Ishii, both of Shizuoka, Japan

[73] Assignee: Fuji Photo Film Co., Ltd., Kanagawa, Japan

[21] Appl. No.: 239,364

[22] Filed: Sep. 1, 1988

[30] Foreign Application Priority Data

Sep. 4, 1987 [JP] Japan ..... 62-220510

[51] Int. Cl.[4] ..... G03G 5/087

[52] U.S. Cl. ..... 430/87; 430/96

[58] Field of Search ..... 430/87, 96

[56] References Cited

U.S. PATENT DOCUMENTS 3,519,421 7/1980 Cheng ..... 430/96
4,792,511 12/1988 Kato et al. .
4,828,952 5/1989 Kato et al. .

FOREIGN PATENT DOCUMENTS 0255989 2/1988 European Pat. Off. ..... 430/96
1198995 7/1980 United Kingdom ..... 430/96

*Primary Examiner*—Paul R. Michl
*Assistant Examiner*—Jeffrey A. Lindeman
*Attorney, Agent, or Firm*—Sughrue, Mion, Zinn, Macpeak & Seas

[57] ABSTRACT

An electrophotographic master plate for lithographic printing is disclosed. The plate comprises a conductive support having thereon at least one photographic layer containing photoconductive zinc oxide and at least one binder resin, wherein at least one functional group contained in at least one component of the binder resin is a group represented by formula (I)

(I)

wherein X represents wherein Y represents an oxygen atom or a sulfur atom; $R_2$, $R_2$, and $R_3$, each represents a hydrogen atom or an aliphatic group; n represents 5 or 6; Z represents an organic group forming a cyclic imido group; and $R_4$, $R_5$, $R_6$, $R_7$, and $R_8$, each represents a hydrogen atom or an aliphatic group; or at least one of the group $R_5$ and $R_6$ and the group $R_7$ and $R_8$ combine with each other to form a condensed ring.

9 Claims, No Drawings

ELECTROPHOTOGRAPHIC MASTER PLATE FOR LITHOGRAPHIC PRINTING

FIELD OF THE INVENTION

This invention relates to an electrophotographic master plate for lithographic printing, and more particularly to an electrophotographic master plate for lithographic printing plate having an improved binder for the photoconductive layer.

BACKGROUND OF THE INVENTION

Various kinds of offset master plates for direct plate making have been proposed and practically used at present, and of these techniques, a widely used technique of obtaining an offset master plate involves forming toner images having high oleophilic property on the surface of an electrophotographic photosensitive plate having on a conductive support a photoconductive layer mainly composed of photoconductive particles and binder resin through an ordinary electrophotographic process, and then treating the surface of the photosensitive layer with a desensitizing solution called an etching solution for selectively making the non-image portions hydrophilic.

For obtaining good prints, it is necessary that an original is faithfully duplicated on the offset master plate, the surface of the photosensitive material is liable be wetted with a desensitizing solution, and the non-image portion is sufficiently rendered hydrophilic and at the same time has water resistance. Furthermore, in the case of printing, it is necessary that the photoconductive layer carrying images does not peel off, the surface thereof is well wetted with a dampening water, and the surface sufficiently retains the hydrophilic property at the non-image portions such that stains are not formed even in the case of making a large number of prints.

It is well known that the aforesaid performance of the electrophotographic photosensitive material as offset master plate is influenced by the ratio of zinc oxide and a binder resin in the photoconductive layer thereof. For example, if the ratio of a binder resin to zinc oxide particles in a photoconductive layer is low, the desensitizability of the surface of the photoconductive layer is improved and the occurrence of stains on the background is reduced. On the other hand, however, the internal cohesive force of the photoconductive layer itself is reduced to reduce the printing power due to the deficiency in the mechanical strength.

On the other hand, if the proportion of the binder resin is increased, the printing power is improved but the occurrence of stains on the background is increased. In particular, the stains on the background are, as a matter of course, the phenomenon relating to the desensitizability of the surface of the photoconductive layer, and it has been clarified that the desensitizability of the photoconductive layer surface is influenced not only by the ratio of zinc oxide and binder resin in the photoconductive layer, but also by the kind of binder resin.

Examples of such binder resins include for example, silcone resins (JP-B-34-6670), styrenebutadiene resins (JP-B-35-1960), alkyd-resins, maleic acid resins, and polyamides (JP-B-35-11219), vinyl acetate resins (JP-B-41-2455), vinyl acetate copolymers (JP-B-41-2426), acryl resins (JP-B-35-11216), acrylic acid ester copolymers (JP-B-35-11219, 36-8510, and 41-13946), etc. (The term "JP-B" as used herein means an "examined published Japanese patent application").

However, in the electrophotographic photosensitive materials using these resins, there are problems in that: (1) the electrostatic charging property of the photoconductive layer is low; (2) the qualities (in particular, dot reproducibility and resolving power) of the imaged portion of the copies obtained is poor; (3) the exposure sensitivity is low; (4) when a desensitization treatment is applied for using as an offset master, the desensitization is not sufficiently performed, which results in causing stains on the background of the prints in offset printing; and (5) the film strength of the photosensitive layer is insufficient, whereby, upon offset printing, peeling off, etc., of the photoconductive layer occurs, to reduce the printing power.

In particular, for offset master plates, the occurrence of stains on background by the insufficient desensitization is a large problem as described above, and, for overcoming these problems, the development of binder resins for zinc oxide for improving the desensitizability of the photoconductive layer have been variously investigated. For example, resin systems having an effect of improving the desensitizability of photoconductive layers include those using a resin having a molecular weight of from $8\times10^4$ to $1\times10^5$ and having Tg of from 10° C. to 80° C., obtained by copolymerizing a (meth)acrylate series monomer and other monomer in the existence of fumaric acid together with a copolymer composed of a (meth)acrylate series monomer and other monomer described in JP-B-50-31011, the use of a terpolymer containing a (meth)acrylic acid ester having a substituent including a carboxylic acid ester at least 7 carbon atoms apart from the ester bond described in JP-A-53-54027, the use of a 4-component or 5-component copolymer containing acrylic acid and hydroxyethyl (meth acrylate described in JP-A-54-20735 and JP-A-570-202544, and the use of a terpolymer containing a (meth)acrylic acid ester having an alkyl group having from 6 to 12 carbon atoms as a substituent and a vinyl monomer having carboxylic acid group as described in J-A-58-68046. (The term "JP-A" as used herein means an "unexamined published Japanese patent applications".)

However, one practical evaluation of the aforesaid resins which are considered to be effective for the improvement of the desensitizability of the photoconductive layers shows that they are yet unsatisfactory in stains on the background and printing power.

SUMMARY OF THE INVENTION

The present invention has been made for overcoming the aforesaid problems in conventional master plates for electrophotographically making lithographic printing plates.

An object of this invention is, therefore, to provide an electrophotographic master plate for lithographic printing which can faithfully reproduce duplicate images of the original, and which is excellent in desensitizability so as to form neither stains over the whole surface thereof nor spot-like stains on the background.

Another object of this invention is to provide an electrophotographic master plate for lithographic printing having high printing power, which can sufficiently retain the hydrophilic property of the non-image portions and does not cause stains on the background even in the case of increasing the number of prints.

It has now been discovered that the aforesaid objects can be attained by the present invention as set forth hereinbelow.

That is, the invention provides an electrophotographic master plate for lithographic printing comprising a conductive support having thereon at least one photoconductive layer containing photoconductive zinc oxide and at least one binder resin, wherein at least one functional group contained in at least one component of the binder resin is a group represented by formula (I)

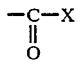

(I)

wherein X represents

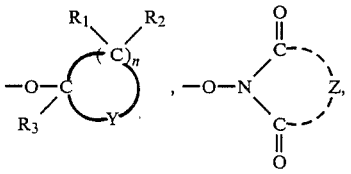

wherein Y represents an oxygen atom or a sulfur atom; $R_1$, $R_2$, and $R_3$ (which may be the same or different) each represents a hydrogen atom or an aliphatic group; n represents 5 or 6; Z represents an organic group forming a cyclic imido group; and $R_4$, $R_5$, $R_6$, $R_7$, $R_8$ (which may be the same or different) each represents a hydrogen atom or an aliphatic group; or at least one of the group $R_5$ and $R_6$ and the group $R_7$ and $R_8$ combine with each other to form a condensed ring.

The functional group shown by formula —CO—X described above forms a carboxy group by decomposition.

DETAILED DESCRIPTION OF THE INVENTION

Then, the invention is described in detail.

When X represents

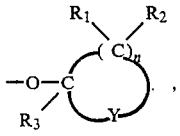

Y represents an oxygen atom or a sulfur atom; $R_1$, $R_2$, and $R_3$ (which may be the same or different) each preferably represents a straight chain or branched alkyl group having from 1 to 18 carbon atoms, which may be substituted (e.g., methyl, ethyl, propyl, butyl, hexyl, octyl, decyl, dodecyl, octadecyl, chloroethyl, methoxyethyl, and methoxypropyl), a alicyclic group which may be substituted (e.g., cyclopentyl and cyclohexyl), an aralkyl group having from 7 to 12 carbon atoms, which may be substituted (e.g., benzyl, phenetyl, chlorobenzyl, and methoxybenzyl), an aromatic group which may be substituted (e.g., phenyl, naphthyl, chlorophenyl, tolyl, methoxyphenyl, methoxycarbonyl, and dichlorophenyl), or —0—R′ (wherein R′ represents a hydrocarbon group which is selected from the same hydrocarbon groups as described for $R_1$, $R_2$, or $R_3$ above); and n represents 3 or 4.

When X represents

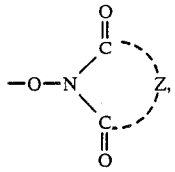

Z represents an organic group forming a cyclic imido group and is preferably the organic group represented by following formula (II) or (III);

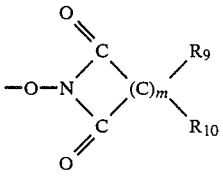

(II)

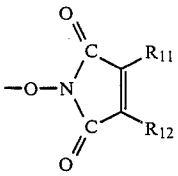

(III)

wherein $R_9$ and $R_{10}$, which may be the same or different, each represents a hydrogen atom, a halogen atom (e.g., chlorine and bromine), an alkyl group having from 1 to 18 carbon atoms, which may be substituted (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl ethyl, and 2-(ethoxyoxy)ethyl), an aralkyl group having from 7 to 12 carbon atoms, which may be substituted (e.g., benzyl, phenethyl, 3-phenylpropyl, methylbenzyl, dimethylbenzyl, methoxybenzyl, chlorobenzyl, and bromobenzyl), an alkenyl group having from 3 to 18 carbon atoms, which may be substituted (e.g., allyl, 3-methyl-2-propenyl, 2-hexenyl, 4-propyl-2-pentenyl, and 12-octadecenyl), —S—$R_{13}$ (wherein $R_{13}$ represents the same group as the alkyl group, aralkyl group, or alkenyl group represented by $R_9$ or $R_{10}$ described above or an aryl group which may be substituted (e.g., phenyl, tolyl, chlorophenyl, bromophenyl, methoxyphenyl, ethoxyphenyl, and ethoxycarbonylphenyl)), or —$NHR_{14}$ (wherein $R_{14}$ has the Same meaning as $R_{13}$ described above).

Also, $R_9$ and $R_{10}$ may combine to form a ring, and examples of the ring include a 5- or 6-membered monocyclic ring (e.g., cyclopentyl and cyclohexyl), and a 5- or 6--membered bicyclo ring (e.g., bicycloheptane, bicycloheptene, bicyclooctane and bicyclooctene). Furthermore, these rings may be substituted by substituents the same as those described above as to $R_9$ and $R_{10}$.

In formula (II), m represents 2 or 3.

In formula (III), $R_{11}$, and $R_{12}$, which may be the same or different, each has the same meaning as $R_9$ and $R_{10}$ described above. Furthermore, $R_{11}$ and $R_{12}$ may combine to form an aromatic ring, e.g., benzene and naphthalene.

When X represents

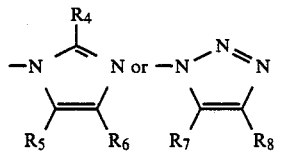

wherein $R_4$, $R_5$, $R_6$, $R_7$, and $R_8$ each represents a hydrogen atom or an aliphatic group which is preferably same as those represented by $R_1$, $R_2$, or $R_3$ described above. Also, said $R_5$ and $R_6$ or said $R_7$ and $R_8$ may combine to form a condensed ring such as, preferably, a 5- or 6-membered monocyclic aliphatic ring (e.g., cyclopentyl and cyclohexy, a 5- to 12-membered aromatic ring (e.g., benzene ring, naphthalene ring, thiophene ring, pyrrole ring, pyran ring, and quinoline ring), etc.

The resin for use in this invention having at least one functional group selected from the groups represented by formula —CO—X described above can be produced by a method of converting a carboxy group or a carboxylic acid halide group of a polymer into the functional group shown by formula —CO—X by a high polymer reaction or a method of polymerizing one or more monomers having at least one functional group shown by formula —CO—X or the aforesaid monomer and other copolymerizable monomer by a polymerization reaction.

The conversion of the carboxy group or the carboxylic acid halide group in the monomer into the functional group can be carried out in the same manner as described above for the conversion of the group contained in the polymer.

A method of converting the carboxy group of a monomer into the functional group shown by formula —CO—X is described e.g., *Shin Jikken Kaoaku Koza* (*New Experimental Chemistry Course*), Vol. 14, page 2535, "Synthesis and Reaction of Organic Compound [V]", edited by the Chemical Society of Japan, published by Maruzen K.K , and in J.F.W. Meomie, *Protective Groups in Orqanic Chemistry.*

For the reasons that the functional group shown by formula —CO—X in the polymer can be optionally adjusted or the product is not incontaminated by impurities, the method of producing the resin for use in this invention from the monomer(s) having the functional group of formula —CO—X by the polymerization reaction is preferred. Practically, the resin can be produced by the method of converting the carboxy group(s) having a polymerizable double bond and at least one carboxy group into the functional group(s) of formula (I), 13 CO—X, by the method described in the aforesaid literatures, etc., or by the method of reacting a compound having the functional group of formula (I) and a compound having a polymerizable double bond.

The monomer having the functional group shown by formula —CO—X, which is used in the aforesaid method of producing the desired resin by the polymerization reaction is, for example, a compound shown by formula (IV) although the invention is not limited to the compound.

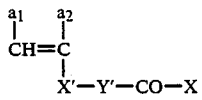

(IV)

wherein X' represents —O—, —CO—, —COO—, —OCO—,

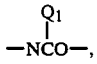

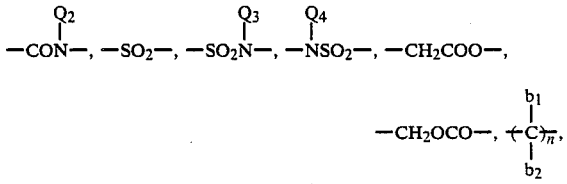

an aromatic group, or a heterocyclic group (wherein $Q_1$, $Q_2$, $Q_3$, and $Q_4$ each represents a hydrogen atom, a hydrocarbon group, or —Y'—CO—X in formula (IV) described above; $b_1$ and $b_2$, which may be the same or different, each represents a hydrogen atom, a hydrocarbon group or —Y'—CO—X in formula (IV); and n represents an integer of from 0 to 18); Y' represents a carbon-carbon bond of bonding a linkage group X' and a bonding group —CO—X through, if necessary, a hetero atom (examples of the hetero atom are oxygen, sulfur and nitrogen), such as, for example,

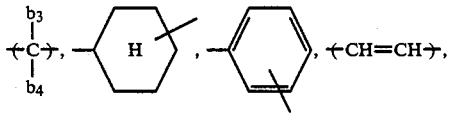

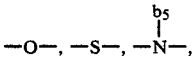

—COO—, —CONH—, —$SO_2$—, —$SO_2$NH—, —NHCOO—, —NHCONH—, etc., singly or as a combination thereof (wherein $b_3$, $b_4$, and $b_5$ each has the same meaning as defined above for $b_1$ and $b_2$); X has the same meaning as defined above in formula (I); and $a_1$ and $a_2$, which may be the same or different, each represents a hydrogen atom, a hydrocarbon group (e.g., an alkyl group having from 1 to 12 carbon atoms, which may be substituted by —COOH, etc.), —COOH, or —COO—W (wherein W is an alkyl group having from 1 to 18 carbon atoms, an alkenyl group, an aralkyl group, an aliphatic group, or an aromatic group, each group of which may be substituted by a group containing a group represented by formula —CO—X).

Practical examples of the component having the functional group shown by formula (I) are illustrated below but the invention is not limited thereto.

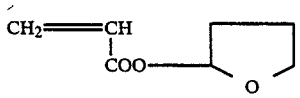

(1)

-continued
(2)
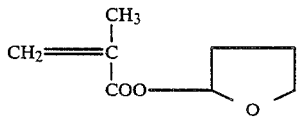
(3)
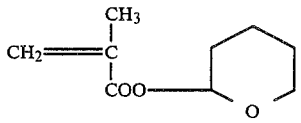
(4)
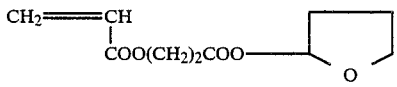
(5)
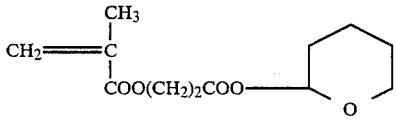
(6)
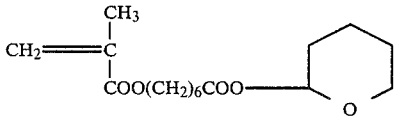
(7)
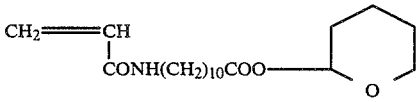
(8)
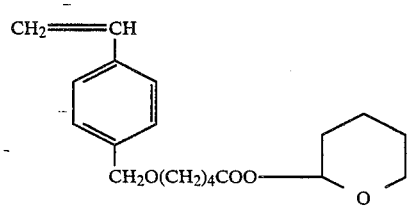
(9)
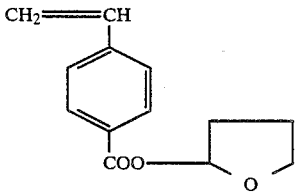
(10)
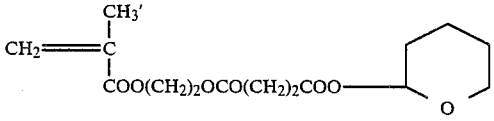
(11)
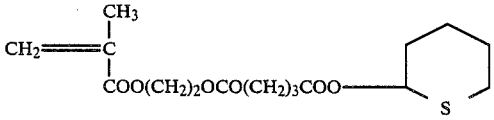
(12)
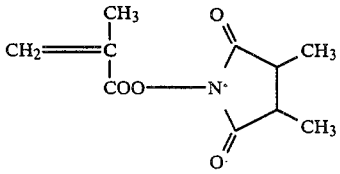

-continued
(13)
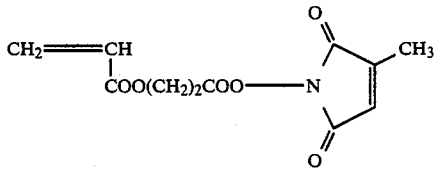
(14)
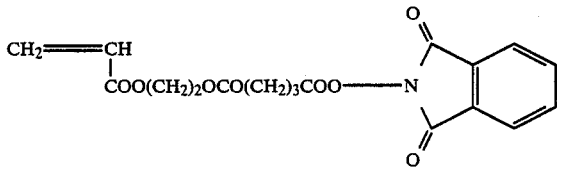
(15)
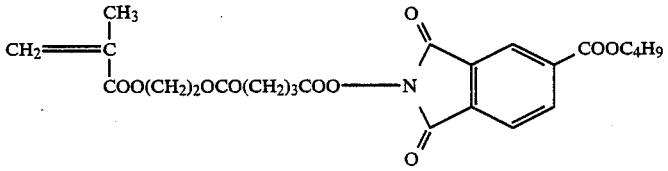
(16)
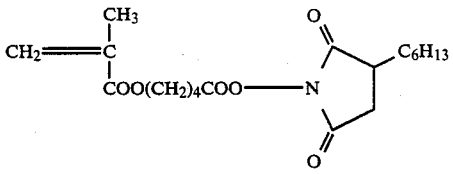
(17)
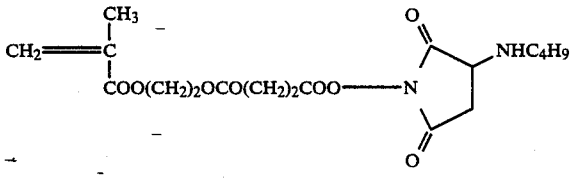
(18)
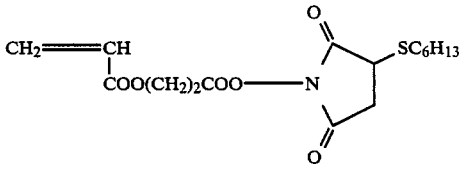
(19)
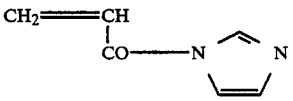
(20)
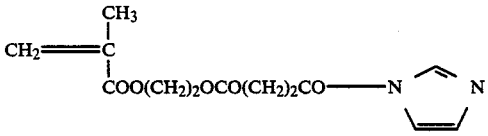
(21)
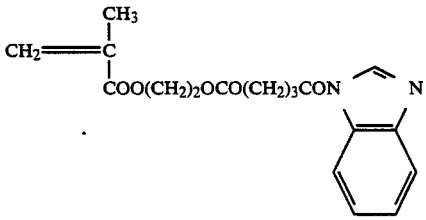

-continued
(22)
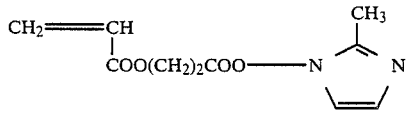
(23)
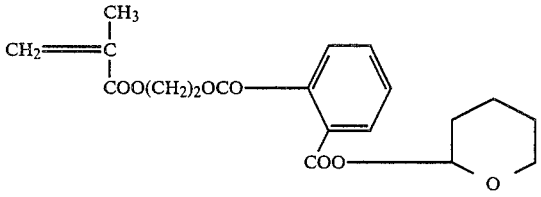
(24)
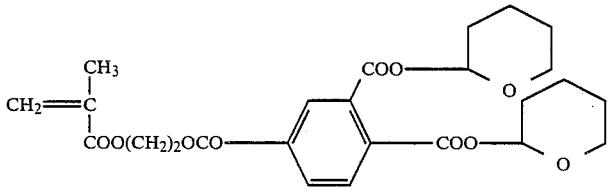
(25)
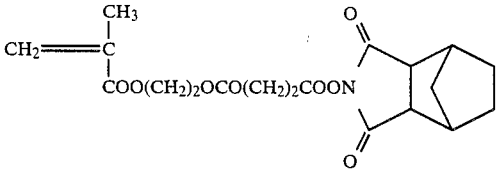
(26)
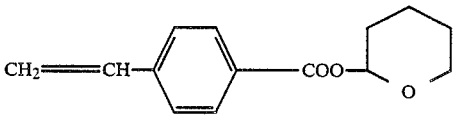
(27)
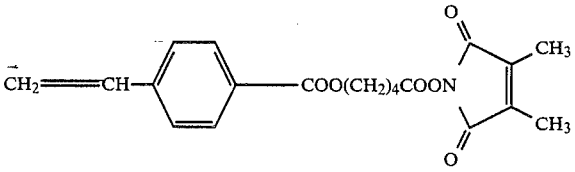
(28)
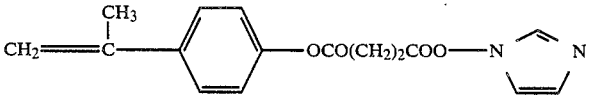
(29)
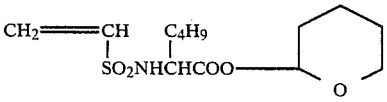
(30)
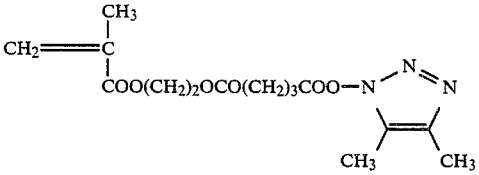
(31)
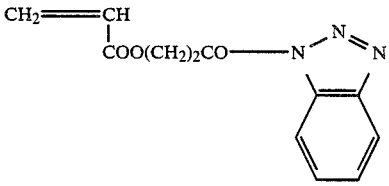

-continued (32)

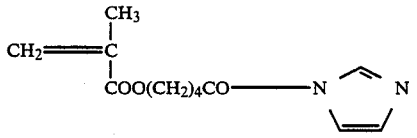

The molecular weight of the resin of this invention is generally from $1\times10^3$ to $1\times10^6$, and preferably from $5\times10^3$ to $1\times10^5$.

Also, the resin having the functional group shown by formula (I) is a homopolymer or a multi-component copolymer composed of from 0.5 to 100% by weight polymerizable component(s) having the functional group of formula (I), and is preferably a multi-component copolymer containing from 1 to 99.9% the component(s) having the functional group shown by formula (I).

In this invention, the aforesaid resin can be used together with a conventional resin such as, for example, silicone resins, alkyd resins, vinyl acetate resins, polyester resins, styrene-butadiene resins, acryl resins, etc., described above. Practical examples of such resins are described in Ryuuji Kurita and Jiro Ishiwata, *Koobunshi* (*High Molecules*), Vol. 17, p. 278 (1969) and Harumi Miyamoto and Hidehiko Takei, *Imaging*, No. 8, p. 9 (1973).

The resin for use in this invention can be mixed with the aforesaid conventional resin at any optional mixing ratio, but, in such case, it is desirable that the component having the functional group of formula (I) exists in the whole resin in an amount of from 0.5 to 60% by weight, and preferably from 1 to 30% by weight.

If the content of the component having the functional group shown by formula (I) is less than 0.5% by weight, the electrophotographic master plate for lithographic printing plate obtained using the resin has insufficient hydrophilic property imparted by a desensitization treatment using a desensitizing solution and dampening water to cause stains at printing. On the other hand, if the content of the component is larger than 60% by weight, the image-forming property of the photosensitive plate at electrophotographic duplication is poor as well as the film strength of the photosensitive layer becomes weak at printing to reduce the durability of the printing plate.

The resin for use in this invention containing at least one functional group shown by formula (I) described above is a resin which is hydrolyzed or hydrogenolyzed by a desensitizing solution at the desensitizing treatment or dampening water upon printing to form a carboxy group.

Accordingly, when the aforesaid resin is used as the binder resin for an electrophotographic master plate for lithographic printing plate, the hydrophilic property of the non-image portions imparted by the treatment of a desensitizing solution is further increased by the carboxy group formed in the resin described above, whereby the difference between the oleophilic property of the imaged portion and the hydrophilic property of the non-image portions becomes clearer and attaching of a printing ink onto the non-image portions during printing is prevented.

On the other hand, when a conventional resin having a carboxy group itself is used, the viscosity of a dispersion of zinc oxide in the resin becomes high and hence the dispersion cannot be coated on a support, or, even if the dispersion can be coated thereon the electrophotographic master plate thus obtained shows very poor smoothness of the photoconductive layer, thus reducing the film strength and electrophotographic characteristics, as well as causing stains upon printing.

That is, it appears that since the interaction between the carboxy group in the binder resin and the surfaces of the photoconductive zinc oxide particles is strong, the amount of the resin adsorbed on the surface of the zinc oxide particles is increased, which results in losing the wetting property of the surface of the photoconductive layer with a desensitizing solution or dampening water.

In the resin for use in this invention, however, the carboxy group is protected to provide the functional group shown by formula —CO—X, whereby the strong interaction between the resin and the zinc oxide particles is restrained, and on the other hand, by forming a carboxy group which is a hydrophilic group by a desensitizing treatment, the hydrophilic property of the non-image portions is further improved.

For the electrophotographic master plate for lithographic printing plate of this invention, the aforesaid binder resin is generally used in an amount of from 10 to 60% by weight, and preferably from 15 to 30% by weight based on the weight of photoconductive zinc oxide.

In this invention, if necessary, various kinds of dyes can be used as a spectral sensitizer. Examples of these dyes are carbanium dyes, diphenylmethane dyes, triphenylmethane dyes, xanthene series dyes, phthalein series dyes, polymethine dyes (e.g., oxanols, merocyanines, cyanines, rhodacyanines, and styryls), and phthalocyanine dyes (which may contain a metal) as described in Harumi Miyamoto and Hidehiko Takei, *Imaging*, No. 8, p 12 (1973), Koohei Tsuda, *Denkitsushin Gakkai Ronbun Shi* (*Journal of Electric Communication*), J 63-C, No. 2, 97(1980), C. J. Young et al, *RCA Review*, 15, 469(1954), Yuuji Harasaki, *Kogyo Kagaku Zashhi* (*Journal of Industrial Chemistry*), 66, 78 and 188(1963), and Tadaaki Tani, *Journal of the Society of Photographic Science and Technology of Japan*, 35, 208(1972).

More practically, there are carbonium series dyes, triphenylmethane series dyes, xanthene series dyes and phthalein series dyes, as described, e.g., in JP-B-51-452, JP-A-50-90334, JP-A-50-114227, JP-A-53-39130, JP-A-53-82353, JP-A-57-16456, and in U.S. Pats. 3,052,540 and 4,054,450.

Also, as polymethine dyes such as oxonol dyes, merocyanine dyes, cyanine dyes, rhodanine dyes, etc., the dyes described in F. M. Harmmer, *The Cyanine Dyes and Related Compounds*, etc., can be used. More practically, useful dyes include those described in U.S. Pats. 3,047,384, 3,110,591, 3,121,008, 3,125,447, 3,128,179, 3,132,942, and 3,662,317, British Pats. 1,226,892, 1,309,274, and 1,405,898, JP-B-48-7814 and JP-B-55-18892.

Furthermore, polymethine dyes capable of spectrally sensitizing the near infrared to infrared regions having long wavelengths of longer than 700 nm include dyes as described in JP-B-51-41061, JP-A-47-840, JP-A-47-44180, JP-A-49-5034, JP-A-49-45122, JP-A-57-26245, JP-A-56-35141, JP-A-57-157254, JP-A-61-26044, and JP-A-61-27551, U.S. Pats. 3,619,154 and 4,175,956, and in *Research Disclosure,* No.216, pages 117–118 (1982).

The electrophotographic photosensitive material of this invention is also excellent in the point that even when various kinds of sensitizing dyes are used, the performance is reluctant to deviate due to the sensitizing dyes.

Moreover, if necessary, various additives for electrophotographic photosensitive layers conventionally known as chemical sensitizers, etc., can be used in this invention. Examples of such additives include the electron acceptive compounds (e.g., halogen, benzoquinone, chloranyl, acid anhydrides, and organic carboxylic acids) described in *Imaging,* No. 8, page 12 and polyarylalkane compounds, hindered phenol compounds and p-phenylenediamine compounds described in Hiroshi Komon, *Saikin No KoododenzairVo to Kankootai no Kaihatsu.Jituyo Ka* (*Recent Development and Utilization of Photoconductive Materials and Photosensitive Materials*), Chapters 4 to 6 published by Nippon Kagaku Jooho Sha (1986).

There is no particular restriction on the addition amount of these additives, but the amount is usually from 0.0001 to 2.0 parts by weight to 100 parts by weight of the photoconductor.

The photoconductive layer in this invention can be formed on a support conventionally used in the field of the art. In general, it is preferred that a support for the electrophotographic photosensitive layer is a conductive support. Examples of the conductive support are metal sheets, substrates such as papers and plastic sheets subjected to a conductivity-imparting treatment such as the impregnation of a low-resistance material, substrates imparted with conductivity on the back surface thereof (a surface opposite to the surface carrying the photosensitive layer) having at least one coated layer for preventing the occurrence curling, the aforesaid support having further a water-resisting adhesive layer on the surface thereof, the aforesaid support having, if necessary, at least one pre-coat, and papers laminated with a plastic film imparted with conductivity by the vapor deposition of aluminum, etc.

Practical examples of conductive substrates and conductivity-imparting materials are described in Yukio Sakamoto, *Denshi Shashin* (*Electrophotography*), No. 1, pp 2–11(1975), Hiroyuki Moriga, *Nyumon Tokushi Shi no Kaqaku* (*Chemistry of Specific Papers*), published by Koobunshi Kanko Kai, 1975, and M. F. Hoover and J. Macromol, *Sci. Chem.*, A-4(6), pp. 1327–1417(1970).

The following examples serve to illustrate the invention without limiting, however, the scope thereof.

EXAMPLE 1 AND COMPARISON EXAMPLES

After heating a mixed solution of 36 g of n-butyl methacrylate, 54 g of ethyl methacrylate, 10 g of Compound (4) described above, and 200 g of toluene to 70° C. under a nitrogen gas stream, 10 g of azobisisobutyronitrile (AIBN) was added thereto followed by performing reaction for 8 hours. The weight average molecular weight of the copolymer obtained was 65,000. Then, by dispersing a mixture of 30 g of the copolymer obtained as solid, 10 g of a copolymer of butyl methacryate and acrylic acid (98/2) (weight average molecular weight 45,000), 200 g of zinc oxide, 0.05 g of Rose Bengale, 0.01 g of phthalic anhydride, and 300 g of toluene in a ball mill for 2 hours, a coating composition for forming a photosensitive layer was prepared and the coating composition was coated on a paper subjected to conductive treatment at a dry coverage of 25 g/m$^2$ by means of a wire bar, dried for one minute at 110° C. and then allowed to stand in the dark for 24 hours at 20° C. under relative humidity of 65% to provide an electrophotographic photosensitive material.

By following the aforesaid procedure except that the copolymer shown below was used for forming the photosensitive layer, Comparison Photosensitive Materials A, B and C were prepared.

Comparison Photosensitive Material A:

An electrophotographic photosensitive material A was prepared by following the same procedure as above except that a mixed solution of 40 g of n-butyl methacrylate, 60 g of ethyl methacrylate, 0.2 g of acrylic acid, and 200 g of toluene was used in place of the mixed solution in the above procedure. In this case the solid concentration of the copolymer obtained was 33.28% and the weight average molecular weight of the copolymer was 68,000.

Comparison Photosensitive Material B:

An electrophotographic photosensitive material B was prepared by following the same procedure as above except that a mixed solution of 38 g of n-butyl methacrylate, 57 g of ethyl methacrylate, 5.0 g of acrylic acid, and 200 g of toluene in place of the mixed solution in the above procedure. In this case the solid concentration of the copolymer obtained was 33.3% and the weight average molecular weight of the copolymer was 72,000.

Comparison Photosensitive Material C:

An electrophotographic photosensitive material C was prepared by following the same procedure as above except that a mixed solution of 34 g of n-butyl methacrylate, 51 g of ethyl methacrylate, 15 g of acrylic acid, and 200 g of toluene was used in place of the mixed solution in the above procedure. In this case the solid concentration of the copolymer obtained was 33.3% and the weight average molecular weight was 67,000.

The film forming property (smoothness of the surface), the electrostatic characteristics, the desensitizability of photoconductive layer (shown by the contact angle with water of the photoconductive layer after desensitizing treatment), and the printing properties (stains on background, printing durability, etc.,) of these photosensitive materials were determined.

The printing properties were determined by using each lithographic printing plate obtained by forming toner images thereon by imagewise exposing the photosensitive material and developing using an automatic printing plate making machine ELP 404V (made by Fuji Photo Film Co., Ltd.) and an electrophotographic developer ELP-T (made by Fuji photo Film Co., Ltd.) and etching the surface thereof by an etching processor using a desensitizing solution ELP-E (made by Fuji Photo Film Co., Ltd.). In addition, as the printing machine, Hamada Star Type 800SX (made by Hamada Star K.K.) was used.

The results obtained are shown in Table 1 below.

TABLE 1

| | Example 1 | Comparative Example A | Comparative Example B | Comparative Example C |
|---|---|---|---|---|
| Smoothness of photoconductive Layer(1) (sec/cc) | 85 | 80 | 60 | 10 |
| Electrostatic characteristics(2) | 555 | 550 | 560 | 600 |

TABLE 1-continued

| | Example 1 | Comparative Example A | Comparative Example B | Comparative Example C |
|---|---|---|---|---|
| $V_0$ (volt) | | | | |
| $E_{1/10}$ (lux.sec) | 8.0 | 8.0 | 9.2 | 14.0 |
| Contact Angle with water (degree)(3) | 13° | 20° | 17° | 25° |
| Image Quality of Toner Images | Good | Good | Fair | Poor |
| Stain I on Background of Prints(4) | 1 | 2–3 | 3 | 4 |
| Stain II on Background of Prints | 1 | 3 | 4 | 5 |
| Printing Durability(5) | No stain after more than 10,000 prints | Stained after 3,000 prints | Stained after 100 prints | Stained from the beginning of printing |

The properties in Table 1 were evaluated as follows.

(1) Smoothness of Photoconductive Layer:

The smoothness (sec/c.c.) of each photosensitive material obtained was measured using a Beck's Smoothness Test Machine (made by Kumagaya Rikoo K.K.) under the condition of air capacity of 1 c.c.

(2) Electrostatic characteristics:

After applying corona discharging to each photosensitive material in the dark for 20 seconds using a paper analyzer (Paper Analyzer Type SP-428, made by Kawaguchi Denki K.K.) at 20° C. and 65% RH and at −6 kV, the photographic material was allowed to stand for 10 seconds and the surface potential $V_o$ in this case was measured. Then, the surface of the photoconductive layer was irradiated by visible light having an illuminance of 20 lux, and the time required for decaying the surface potential ($V_o$) to 1/10 was determined and the exposure amount $E_{l/1O}$ (lux.sec. was calculated from the value.

(3) Contact Angle with Water:

After subjecting the surface of the photoconductive layer to a desensitizing treatment by passing each photosensitive material once through the etching processor using a desensitizing solution ELP-E (made by Fuji Photo Film Co., Ltd.),.a water drop of 2 microliters of distilled water was placed on the surface and the contact angle of the surface with the water drop formed was measured by a goniometer.

(4) Stains on Background of Print:

Each photosensitive material was processed by an automatic plate making machine ELP 404V (made by Fuji Photo Film Co., Ltd.) to form toner images, the surface of the photoconductive layer carrying toner images was desensitized by the same conditions as 3) described above, the printing plate thus obtained was mounted on an offset printing machine (Hamada Star Type 800SX, made by Hamada Stat K.K.) as offset master to print on 500 wood free papers, and then the stains on background were observed by eyes on the whole prints obtained. The stains were defined as Stain I on background of print.

Stain II on background of print was measured in the same manner as above, except that the desensitizing solution was diluted 5 times and dampening water during printing was diluted twice. Stain II corresponds to the case of printing under severer conditions than Stain I.

In Table 1, "1" denotes no background stain, "2" denotes small amount of stains, "3" denotes fair amount of stains, "4" denotes large amount of stains, and "5" denotes stains on substantially entire surface.

(5) Printing Durability

Each photosensitive material was processed under the evaluation condition of Stain I of print in 4) described above and the number of prints capable of printing without causing stains on background at the nonimage portions of the print and problems on the quality of the imaged portions was shown as the printing durability. (The larger number of prints shows better printing durability.).

The results obtained show that the toner images obtained using the photosensitive material of this invention and Comparison Example A were all clear, but in the cases of Comparison Examples B and C, much fog was formed in the non-image portions, and image quality was not clear. Furthermore, in Comparison Example C, the smoothness of the surface of the photoconductive layer was greatly reduced.

Furthermore, the contact angle of each photosensitive material desensitized by the desensitizing solution with water was small in the photosensitive material of this invention, but was larger than 15° in the comparison samples. (Usually, the smaller the contact angle, the higher the hydrophilic property.). Also, when printing was carried out using each material as master plate for offset printing, good prints were obtained without causing stains on background in non-image portions in the case of the master plate of this invention only.

Still further, when 10,000 prints were printed using the printing plate made by the master plate of this invention, the image quality of the prints were good, and no stains on the background were caused. On the other hand, in the cases of using the master plates of Comparison Examples A to C, stains on the background were caused, and in the case of using the master plates of Comparison Examples B and C, wherein the copolymers containing a large amount of COOH group were used as each binder resin, the formation of stains was severe.

The aforesaid results show that the photosensitive material of this invention is a very excellent master plate for offset printing satisfying electrophotographic characteristics and capable of giving many prints without causing stains on background.

EXAMPLE 2

After heating a mixed solution of 51 g of benzyl methacrylate, 34 g of butyl methacrylate, 15 g of Compound (5) described above, 0.3 g of methacrylic acid, and 200 g of toluene to 75° C. under a nitrogen gas stream, 10 g of IBN was added thereto followed by reacting for 8 hours.

The weight average molecular weight of the copolymer obtained was 54,000.

Then, by following the same procedure as in Example 1 using the copolymer obtained, a photosensitive material was prepared. When toner images were formed thereon by means of an automatic plate making machine ELP 404V, the density of the master plate for offset printing obtained was above 1.0 and toner images formed were clear. Furthermore, when the master plate was subjected to etching treatment and used for printing by a printing machine, 10,000 prints having clear images and without having fog in non-image portions were obtained.

EXAMPLE 3

After heating a mixed solution of 20 g of styrene, 70 g of ethyl methacrylate, 10 g of Compound (12) described above, and 200 g of toluene to 80° C. under a nitrogen gas stream, 1.5 g of AIBN was added thereto followed by reacting for 8 hours. The weight average molecular weight of the copolymer obtained was 33,000.

By following the same procedure as in Example 1 except that 30 g of the copolymer as solid and also 10 g of a copolymer of ethyl methacrylate and acrylic acid (99/1 by weight ratio) were used in place of the copolymers in Example 1, a photosensitive material was prepared.

When toner images were formed by using the apparatus as in Example 1, the density of the images of the master plate obtained was above 0.9 and the image quality was clear. Furthermore, when the master plate was subjected to an etching treatment and used for printing by the printing machine, the prints, after printing 10,000 prints, had no fog and clear images.

Furthermore, after allowing the photosensitive material to stand, the same procedure as above was applied, but no change was observed.

EXAMPLE 4

After heating a mixed solution of 30 g of butyl methacrylate, 55 g of ethyl methacrylate, 15 g of Compound (20) of this invention, 0.1 g of itaconic acid, and 200 g of toluene to 75° C. under a nitrogen gas stream, 10 g of AIBN was added thereto followed by reacting for 8 hours The weight average molecular weight of the copolymer obtained was 56,000.

Then, by following the same procedure as in Example 1 using the copolymer thus obtained, a photosensitive material was prepared. The photosensitive material was processed by the apparatus as used in Example 1 to form toner images thereon and after applying an etching treatment thereto, the printing plate was used for printing by the printing machine as in Example 1.

The density of the toner images of the master plate for offset master obtained was above 1.0 and the images were clear. Also, the print after printing 10,000 prints had no fog on the background and had clear images.

EXAMPLES 5 TO 11

By following the same procedure as in Example 1 except that the copolymers shown in Table 2 were each used in place of the resin in Example 1, electrophotographic photosensitive materials were prepared.

In each case, the results obtained were substantially the same as those in Example 1.

TABLE 2

| Example No. | Copolymer of Present Invention (Weight Ratio) | Weight Average Molecular Weight of Copolymer |
|---|---|---|
| 5 | 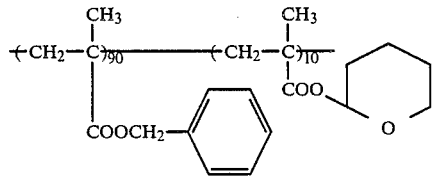 | 30,000 |
| 6 | 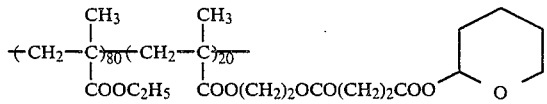 | 35,000 |
| 7 | 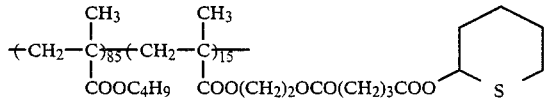 | 40,000 |
| 8 | 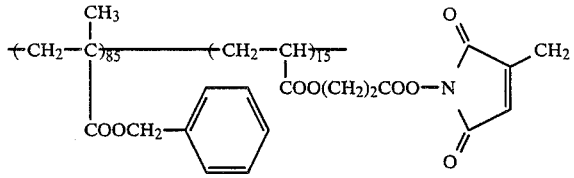 | 38,000 |
| 9 | 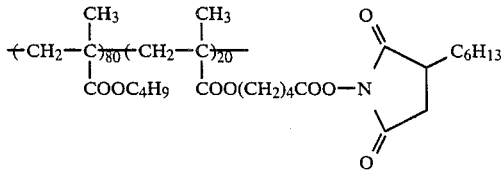 | 35,000 |

TABLE 2-continued

| Example No. | Copolymer of Present Invention (Weight Ratio) | Weight Average Molecular Weight of Copolymer |
|---|---|---|
| 10 | 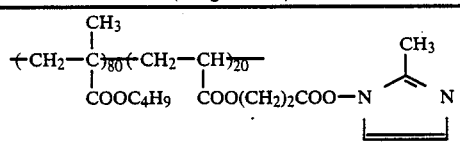 | 36,000 |
| 11 | 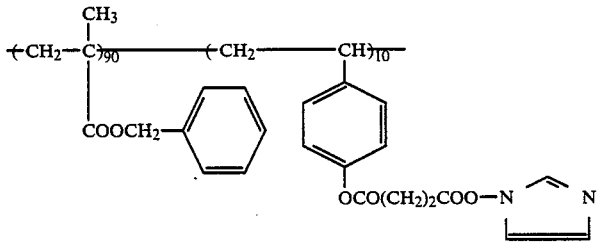 | 32,000 |

As described above, in the electrophotographic master plate for lithographic printing, the toner images formed were clear and the non-image portions have no stains on the background. Also, the master plate has a small contact angle with water and has good wettability with dampening water. Furthermore, the printing plate prepared from the master plate gives prints having good image quality and no stains on the background, has high printing power, and the image quality of prints after printing a large number of prints is good.

While the present invention has been described in detail and with reference to specific embodiments thereof, it is apparent to one skilled in the art that various changes and modifications can be made therein without departing from the spirit and the scope thereof.

What is claimed is:

1. An electrophotographic master plate for lithographic printing comprising a conductive support having thereon at least one photoconductive layer containing photoconductive zinc oxide and at least one binder resin, wherein at least one functional group containing in at least one component of the binder resin is a group represented by formula (I)

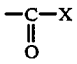

(I)

wherein X is

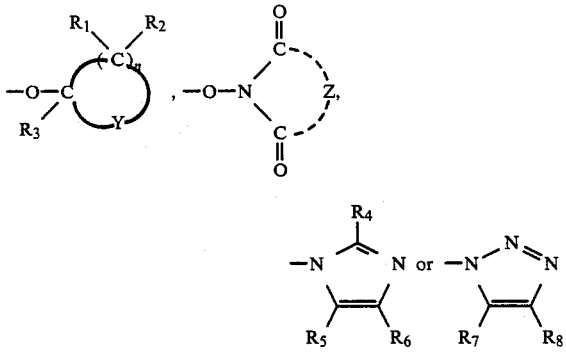

wherein Y is an oxygen atom or a sulfur atom; $R_1$, $R_2$, and $R_3$, each is a hydrogen atom or an aliphatic group; n represents 3 or 4; Z is an organic group forming a cyclic imido group; and $R_4$, $R_5$, $R_6$, $R_7$, and $R_8$, each is a hydrogen atom or an aliphatic group; or at least one group of the group $R_5$ and $R_6$ and the group $R_7$ and $R_8$ combine with each other to form a condensed ring.

2. An electrophotographic master plate for lithographic printing as in claim 1, wherein the molecular weight of the binder resin is from $1\times10^3$ to $1\times10^6$.

3. An electrophotographic master plate for lithographic printing as in claim 1, wherein the molecular weight of the binder resin is from $5\times10^3$ to $1\times10^5$.

4. An electrophotographic master plate for lithographic printing as in claim 1, wherein the component having the function of formula (I) exists in the whole resin content in an amount of from 0.5 to 60% by weight.

5. An electrophotographic master plate for lithographic printing as in claim 1, wherein the component having the function of formula (I) exists in the whole resin content in an amount of from 1 to 30% by weight.

6. An electrophotographic master plate for lithographic printing as in claim 1, wherein the resin binder is present in an amount of from 15 to 30% by weight based on the weight of photoconductive zinc oxide.

7. An electrophotographic master plate for lithographic printing as in claim 1, wherein X is

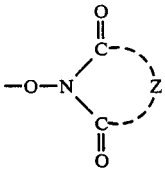

wherein Z is an organic group forming a cyclic imido group represented by the formula (II) or (III):

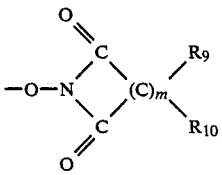

(II)

-continued (III)

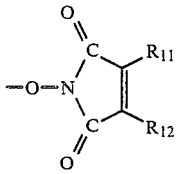

wherein $R_9$ and $R_{10}$ each is a hydrogen atom, a halogen atom, an alkyl group having from 1 to 18 carbon atoms, an aralkyl group having from 7 to 12 carbon atoms, an alkenyl group having from 3 to 18 carbon atoms, —S—$R_{13}$ (wherein $R_{13}$ is the same group as the alkyl, aralky, or alkenyl group $R_9$ or $R_{10}$, or an aryl group), or —$NHR_{14}$ (wherein $R_{14}$ has the same meaning as $R_{13}$), $R_{11}$ and $R_{12}$ each has the same meaning as $R_9$ and $R_{10}$, and m represents 2 or 3.

8. An electrophotographic master plate for lithographic printing comprising a conductive support having thereon at least one photoconductive layer containing photoconductive zinc oxide and at least one binder resin formed from a avinyl monomeric component having, in side chains, a group represented by formula (I)

(I)

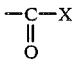

wherein X is

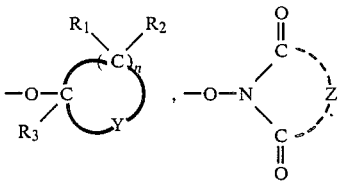

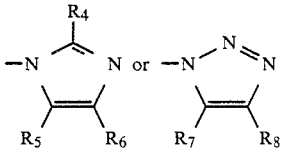

wherein Y is an oxygen atom or a sulfur atom; $R_1$, $R_2$, and $R_3$, each is a hydrogen atom or an aliphatic group, n represents 3 or 4; Z is an organic group forming a cyclic imido group; and $R_4$, $R_5$, $R_6$, $R_7$, and $R_8$, each is a hydrogen atom or an aliphatic group; or at least one of the group $R_5$ and $R_6$ and the group $R_7$ and $R_8$ combine with each other to form a condensed ring.

9. An electrophotographic master plate for lithographic printing as in claim 1, wherein the functional group represented by formula (I) is capable of forming a carboxy group upon decomposition by a desensitizing solution or dampening water.

* * * * *